United States Patent [19]

Lindner et al.

[11] Patent Number: 4,597,620

[45] Date of Patent: Jul. 1, 1986

[54] ELECTRICAL CONNECTOR AND METHOD OF USING IT

[75] Inventors: Melvin Lindner, Huntington; Ronald A. Mackey, Saville, both of N.Y.

[73] Assignee: J. B. Nottingham & Co., Inc., Central Islip, N.Y.

[21] Appl. No.: 579,531

[22] Filed: Feb. 13, 1984

[51] Int. Cl.[4] ..... H01R 13/639

[52] U.S. Cl. ..... 339/89 R; 29/869; 339/91 R; 339/94 R

[58] Field of Search ..... 339/46, 61 R, 61 M, 339/94 R, 89 R, 89 C, 89 M, 91 R, 278 C, 259 R; 285/84, 85, 86, 89, 314, 315; 29/868, 869

[56] References Cited

U.S. PATENT DOCUMENTS

| | | | |
|---|---|---|---|
| 2,566,993 | 9/1951 | Parsons | 339/91 R |
| 2,952,830 | 9/1960 | Sperzel et al. | 339/88 |
| 3,130,269 | 4/1964 | Rountree | 179/1 |
| 3,226,667 | 12/1965 | Senior, Jr. | 339/91 |
| 3,471,824 | 10/1969 | Greulich et al. | 339/61 R |
| 3,487,353 | 12/1969 | Massa | 339/89 |
| 3,493,917 | 2/1970 | Glowacz | 339/74 |
| 3,613,048 | 10/1971 | Brundza | 339/89 R |
| 3,644,871 | 2/1972 | Lafont | 339/46 |
| 3,678,439 | 7/1972 | Vetter | 339/46 |
| 3,697,928 | 10/1972 | Hammell | 339/45 M |
| 3,745,514 | 7/1973 | Brishka | 339/91 R |
| 3,793,610 | 2/1974 | Brishka | 339/74 R |
| 3,829,820 | 8/1974 | Hubner et al. | 339/88 C |
| 3,845,453 | 10/1974 | Hemmer | 339/59 R |
| 3,845,459 | 10/1974 | Normann | 339/191 R |
| 3,960,429 | 6/1976 | Moulin | 339/91 R |
| 3,975,079 | 8/1976 | Blakesley et al. | 339/278 C |
| 4,142,769 | 3/1979 | Wood | 339/88 R |
| 4,154,496 | 5/1979 | Gallagher | 339/89 R |
| 4,163,599 | 8/1979 | Plugge et al. | 339/115 C |

FOREIGN PATENT DOCUMENTS

| | | | |
|---|---|---|---|
| 172661 | 9/1960 | Sweden | 339/94 R |
| 1030976 | 5/1966 | United Kingdom | 339/61 R |

*Primary Examiner*—John McQuade

*Attorney, Agent, or Firm*—Sixbey, Friedman & Leedom

[57] ABSTRACT

An electrical connector assembly comprising first and second mateable connectors is disclosed herein. The first connector includes a collet having an expandable mouth in a concave interior, and the second connector includes a convex member, such as a sphere, which is substantially complementary in shape to the concave interior surface of the collet. The concave interior of the first connector, and the convex member of the second connector surround a male pin and female barrel connector, respectively. The male pin and female barrel mate when the convex member of the second connector is inserted into the concave interior of the first connector. Additionally, the collet is split along its longitudinal axis in order to form a plurality of collet fingers which are closeable by means of a collet which is movable along the outside surface of the collet. A water-tight seal between the male pin and the female barrel of the connectors is accomplished by an O-ring disposed in the mouth of the female barrel.

10 Claims, 6 Drawing Figures

ELECTRICAL CONNECTOR AND METHOD OF USING IT

FIELD OF THE INVENTION

The invention generally relates to male and female electrical connectors which may be mechanically locked together in a water-tight engagement.

DESCRIPTION OF THE PRIOR ART

Male and female electrical connectors which may be locked together in water-tight engagement are known in the prior art. Such connectors find particular use in harsh environments such as shipyards or nuclear power plants. In shipyards, it is often necessary to conduct large amounts of electrical power to electrical arc-welders and other heavy equipment across areas exposed to rain and salt water. Similarly, in nuclear power plants, power must often be conducted to coolant pumps and other equipment in wet, radioactive environments. In both environments, it is necessary to use electrical connectors which are shock resistant as well as water resistant, since it is not unlikely that the connectors will experience a great deal of mechanical shock by being dropped, dragged and maneuvered in place by workmen.

While there are electrical connector assemblies in the prior art which are operable in such harsh environments, most (if not all) have shortcomings which render them difficult to use under certain conditions. Specifically, most heavy duty, locking connectors require some degree of alignment and rotation between the complementary parts in the male and female connectors in order to effect a mechanical lock therebetween. Since the cables which these connectors join are formed from heavily insulated, thick copper wiring, the amount of torsional resistance these cables can exert onto their connectors when such a "twist-lock" mechanism is used is considerable. These torsional forces are particularly strong when the complementary parts in the male and female connectors can only be joined in a single orientation (i.e., in the same manner that a three pronged plug fits into a standard 110 volt outlet, only when the ground plug and blades are properly aligned with the complementary slots and prong receiver of the outlet). If one of the connectors is rigidly mounted onto an electrical panel, the user may be forced to twist the mating connector over 180° in order to engage and lock together the two connectors. Such a twisting motion may create sufficient torsional forces to cause the connectors to spontaneously unlock, particularly if they are dropped or otherwise subjected to a spurious mechanical shock. Additionally, such torsional forces can, under protracted lengths of time, exert metal-fatiguing stresses in the copper conductors in the cables, thereby shortening the lifetime of the cable onto which the connectors are mounted. In the case where such "twist-lock" mechanisms are used in a radioactive environment, the torsional resistance can interfere with a workman's attempt to quickly interconnect the male and female members of the assembly. Such quick interconnection is desirable in order that the workman might minimize his exposure to high energy radiation. Finally, many of the plastic and elastomeric materials used in prior art connector assemblies will degrade upon exposure to such radiation.

Clearly, there is a need for an electrical connector assembly which may be quickly, easily and conveniently locked without the need for a specific alignment between the connectors, and without the need for a torsion-generating, twisting motion between the male and female connectors. Ideally, such a mechanism should be simple in structure and effect a mechanically strong and water-tight joint between the two connectors. The electrical connector should also reliably maintain a good electrical connection even when subjected to a considerable amount of outside mechanical shock. Finally, the connector should be resistant to radiation degradation.

SUMMARY OF THE INVENTION

In its broadest sense, the invention is an electrical connector assembly comprising first and second connectors which may easily be mated and locked without any twisting motions. The first connector includes a collet having an expandable mouth and a concave cavity, and the second connector includes a convex member which is substantially complementary in shape to the concave cavity of the collet. Both the collet of the first connector and the convex member of the second connector are preferably formed from non-conductive materials, and each surrounds first and second electrically conductive elements, respectively. These conductive elements mate when the convex member of the second connector is inserted into the concave cavity of the first connector.

The collet of the first connector may be split to form at least two fingers, and may include a collar moveable along its exterior surface for biasing and securing together the collet fingers. When the collet fingers are thus secured together, the mouth of the collet is locked in an unexpanded position, which in turn locks the convex member of the first connector into the concave cavity of the collet. The exterior surface of the collet and the interior surface of the collar may be threaded, and the collet fingers may be secured together by screwing the collar toward the expandable mouth of the collet. In the alternative, the exterior surface of the collet may be formed from a smooth, resilient metal, and the collar may be slidable along the longitudinal axis of the collet. This alternative structure is particularly desirable in a radioactive environment, where speed of connection and resistance to radiation degradation is of paramount importance. The collet may also include a flange around its exterior surface for protecting the first connector from mechanical shock.

Finally, the first and second electrically conductive elements may include a male pin and a female barrel, respectively. The female barrel may be split along the sides to provide a wiping engagement with the male pin whenever the first and second mateable connectors are mated. Additionally, the convex member of the second connector may house the split female barrel, and may further include a water sealing means, such as an O-ring, for effecting a water-tight seal between the male pin and the split female barrel whenever the connectors are mated.

BRIEF DESCRIPTION OF THE SEVERAL FIGURES

DETAILED DESCRIPTION OF THE PREFERRED EMBODIMENT

General Overview of the Invention

Figure 1:
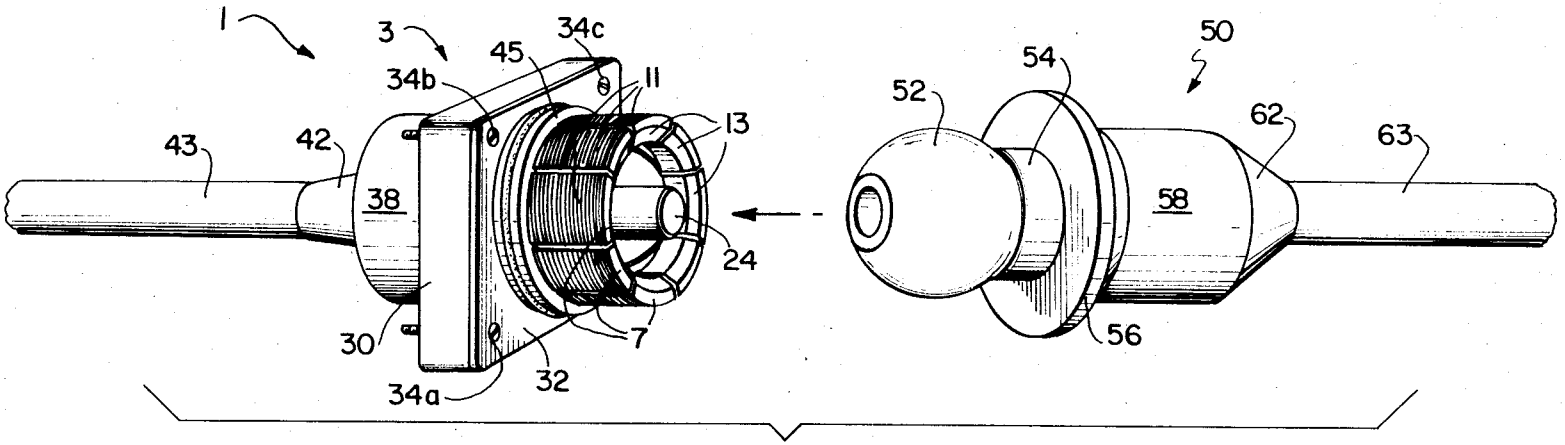
FIG. 1 is a perspective view of both the male and female connectors of the invention.
Figure 3:
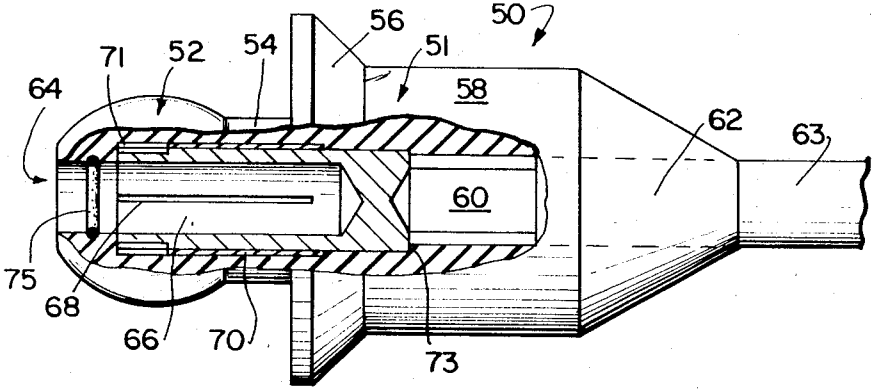
FIG. 3 is a partial cross-sectional view of the female connector of the invention, illustrating the spherical element which is mateable within the expandable collet of the male connector.
Figure 2:
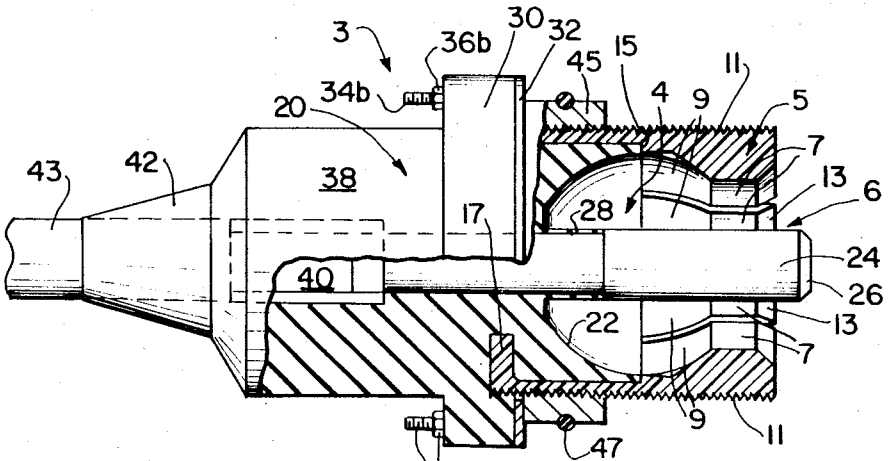
FIG. 2 is a partial cross-sectional view of the male connector, illustrating the expandable collet of the invention.
Figure 4:
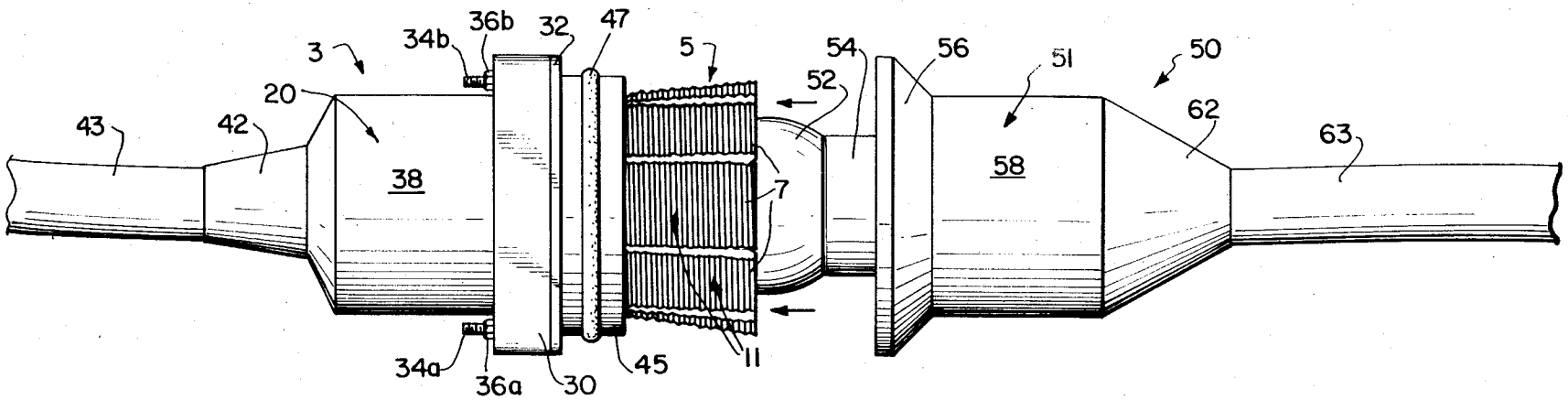
FIG. 4 is a side view of both the male and female connectors of the invention, illustrating them in a partially mated position.

WIth reference now to FIGS. 1, 2 and 3, wherein like numerals denote like parts, the electrical connector assembly 1 of the invention generally comprises a male connector 3 having a spherical cavity 4 which surrounds a male pin 24, and a female connector 50 having an integrally molded, spherical member 52 which houses a female barrel 66. The front half of the spherical cavity 4 of the male connector 3 is defined by a collet 5 having an expandable mouth 6. The exterior of the collet 5 is substantially cylindrically shaped. In the FIGS. 1 and 2 embodiment, collet 5 includes a threaded outside surface 11 onto which a threaded collar 45 is threadedly engaged. In the FIG. 6 embodiment, collet 5 includes a smooth outside surface 12 formed from spring fingers 8 of stainless steel onto which a ring-shaped collar 45 is slidably engaged. When the spherical member 52 of the female connector 50 is inserted into the spherical cavity 4 of the male connector 3 as shown in FIG. 4, the male pin 24 of the male connector 3 wipingly engages the inside of the female barrel 66 of the female connector 50, and the connectors 3 and 50 are both mechanically and electrically engaged. When the collar 45 is screwed or slid toward the expandable mouth 6 of the collet 5 in the position shown in FIG. 5, the connectors 3 and 50 are locked into mechanical and electrical engagement. In the FIG. 6 embodiment, a plastic stop and detent member 21 may be present on the ends of the spring figures 8 to retain the ring-shaped collar 45 when it is slid toward the expandable mouth 6 of collet 5. It should be noted that the male connector 3 may be conveniently inserted into the female connector 50 at any angular orientation, so long as male pin 24 is aligned with cylindrical cavity 64 of the female connector 50. Additionally, no torsional forces are necessary to lock the connectors 3 and 50 into engagement.

Specific Description of the Preferred Embodiment

In the preferred embodiment illustrated in FIGS. 1 and 2, the male connector 3 includes a cylindrical collet 5 having an expandable mouth 6. The collet 5 is preferably split along its cylindrical axis to form a plurality of collet fingers 7 which terminate in and define the expandable mouth 6. The inside surfaces 9 of the collet fingers 7 define a hemispherical surface 9 as shown, while the outside surfaces 11 of the collet fingers 7 are threaded in order to accommodate a threaded collar 46 which may be screwed along the longitudinal axis of collet 5 in order to secure together the collet fingers 7. Threaded collar 45 is provided with a rubber gripping ring 47 so that the user may easily grasp the collar 45 with his fingers while turning it to a desired position along the longitudinal axis of the collar 45. The distil ends of the collet fingers 7 include bevels 13 as shown in order to facilitate the insertion of the spherical member 52 through the expandable mouth 6 of the collet 5. Each of the collet fingers 7 includes an arcuate shoulder 15 in its inside, middle portion in order to effect a smooth engagement between the edges of the hemispherical inside surface 22 of the molded elastomer body 20, and the hemispherical inside surface 9 formed by the inside surfaces of the collet fingers 7. The proximal ends of the collet fingers 7 terminate in flanges 17 anchored within the molded elastomer body 20. In this embodiment, both the collet 5 and the threaded collar 45 are formed from a pigmented, UV-stabilized, polyamide plastic. Such plastics are inherently non-conductive, inert, and flexible. The flexibility of the plastic forming the collet 5, in conjunction with the resilience of the elastomeric material forming the molded elastomer body 20, renders each of the collet fingers 7 resiliently and radially movable relative to the cylindrical axis of the collet 5, and thereby renders the mouth 6 of the collet 5 expandable.

The molded elastomer body 20 of the male connector 3 generally includes a hemispherical cavity 22 which surround a male pin 24, a square mounting flange 30 (which may also be a stop flange), a base portion 38 which houses a cable connection 40, and a stress relief sleeve 42 which circumscribes the portion of the cable 43 entering the base portion 38. The edge of the hemispherical cavity 22 is received within the previously discussed arcuate shoulder 15 present in each of the collet fingers 7, so that the inside, hemispherical surface 9 formed by the inside of the collet fingers 7 smoothly melds with the surface of the hemispherical cavity 22 of the elastomer body 20. Male pin 24 is concentrically disposed within the spherical cavity 4 formed by the insides of the collet fingers 7 and the hemispherical cavity 22 of the elastomer body 20. In the preferred embodiment, the male pin 24 is formed from a copper alloy that has been silver-plated. The distal edge 26 of the male pin 24 is preferably bevelled in order to facilitate the insertion of the pin 24 into the cylindrical cavity 64 and female barrel 66 present in the spherical member 52 of female connector 50. Additionally, the distal end 28 of the male pin 24 is formed with a reduced diameter just beyond its contact area which mates with a sleeve 28 of elastomer projecting out of the hemispherical cavity 22 of the molded elastomer body 20. Sleeve 28 is conveniently formed during the molding operation of elastomer body 20, and mates with O-ring 75 on the female connector 50 in order to form a water-tight seal in a manner which will be described in more detail presently.

The square mounting flange 30 of the molded elastomer body 20 is an integral part of the body 20, as indicated. A cover plate 32 (which is aluminum in this embodiment) lies flat against the front face of the flange 30. The cover plate 32 is maintained in place by means of bolts **34*a*, 34*b*, 34*c* and 34*d* located in the corners of the flange 30. These bolts are secured onto the flange 30 by means of nuts 36*a*, 36*b*, 36*c* and 36*d* which threadedly engage onto their respective bolts. If the user of the connector 1 wishes to mount the connector in a panel, he merely removes the nuts and bolts holding the cover plate 32 onto the front face of the flange 30, and inserts the base 38 through a complementary hole in the panel (not shown). He then secures male connector 3 to the panel by inserting bolts 34*a*, 34*b*, 34*c* and 34*d* through their respective holes in the cover plate 32, panel, and square mounting flange 30, and fastening them in place by means of their respective nuts 36***a*, 36*b*, 36*c* and 36*d*.

Before proceeding to the description of the remaining features of the elastomer body 20, it is important to note that the square mounting flange 30 and cover plate 32 serve two other functions in addition to panel-mounting. First, the flange 30 functions as a shock-absorbing stop-flange whenever the male connector 3 is dropped onto the floor, run over by a motor vehicle, or otherwise subjected to a sudden mechanical shock. If the male connector 3 and the female connector 50 are coupled together in in-line fashion (i.e., not panel-mounted), this shock-absorbing property of flange 30 complements the function of tapered stop flange 56 of female connector 50 in protecting the connector assembly 1 from such shock. Secondly, mounting plate 32 provides a sharp, mechanical stopping point for threaded collar 45 when collar 45 is screwed back into the maximum distal position illustrated in FIG. 2.

The molded elastomer body 20 of the male connector 3 further includes a base portion 38 and a stress relief sleeve 42. The base portion 38 houses the connection 40 between the insulated cable 43, and the male pin 24. The integrally molded elastomer which surrounds the connection 40 and the distal portion of the male pin 24 provides a shockproof, waterproof casing around this connection. Additionally, the stress-relief sleeve 42 which circumscribes the cable 43 entering into the base portion 38 of the connector 3 is likewise integrally molded with the base portion 38, and functions to isolate the wires in the connection 40 from metal-fatiguing stresses which might otherwise occur when the cable 43 was bent close to the base portion 38.

Turning now to FIGS. 1 and 3, the female connector 50 of the connector assembly 1 generally includes a molded elastomer body having an integrally molded, spherical member 52. Spherical member 52 is connected to a base portion 58 by means of a neck 54 which flares into a tapered stop flange 56. Stop flange 56 acts as a shock absorber for the female connector 50 and co-acts with mounting flange 30 of male connector 3 in the manner hereinbefore described. Stop flange 56 also provides a mechanical stop for the collet 5 and the threaded collar 45 when the male connectors 3 and female connectors 50 are mechanically engaged, as will be more specifically described hereinafter.

As may best be seen in FIG. 3, a hollow, substantially cylindrical cavity 64 extends through the spherical member 52, neck 54, and base portion 58 of the connector 50. The distal end of cylindrical cavity 64 is circumscribed by an O-ring 75.

O-ring 75 effects a watertight seal between the male pin 24 and the female connecting spring barrel 66 when the male connector 3 and female connector 50 are mechanically and electrically coupled together. More specifically, when the male pin 24 is completely inserted through the mouth of the cylindrical cavity 24 and through O-ring 75, the O-ring 75 sealingly engages around the elastomeric sleeve 28 located at the base of the pin 24. If water should leak into the expandable mouth 6 of the collet 5, it might travel as far as the spherical inside surfaces 9 of the collet fingers 7 and the surface of the hemispherical cavity 22 in the elastomer body 20, but it would be stopped at the engagement area between O-ring 75 and elastomeric sleeve 28. The center portion of the cylindrical cavity 64 houses the previously-mentioned female barrel 66 between annular shoulders 71 and 73. The female barrel 66 includes at least two slots 68 which allow it to expand slightly in spring-wiping contact whenever the male pin 24 of connector 3 is inserted therethrough. In the preferred embodiment, female barrel 66 is formed from a copper alloy. A brass reinforcing sleeve 70 is concentrically mounted around the outside end of the female barrel 66 next to annular shoulder 71 in order to lend it additional strength and support. The proximal end of the cylindrical cavity 64 houses the connection between the wires in the cable 63 and the female barrel 66. Connection 60 is completely surrounded by the molded elastomeric material forming the base portion 58 of the connector 50 in order to provide a shockproof and waterproof housing for this connection. The base 58 of the female connector 50 terminates in a tapered portion 62 which is integrally molded around the cable 63 as shown. This tapered end portion 62 provides stress relief for the wires in the connection 60 whenever the cable 63 is bent near the base 58 of the female connector 50 in much the same way that sleeve 42 of male connector 3 operates to protect its respective connection 40.

Figure 6:
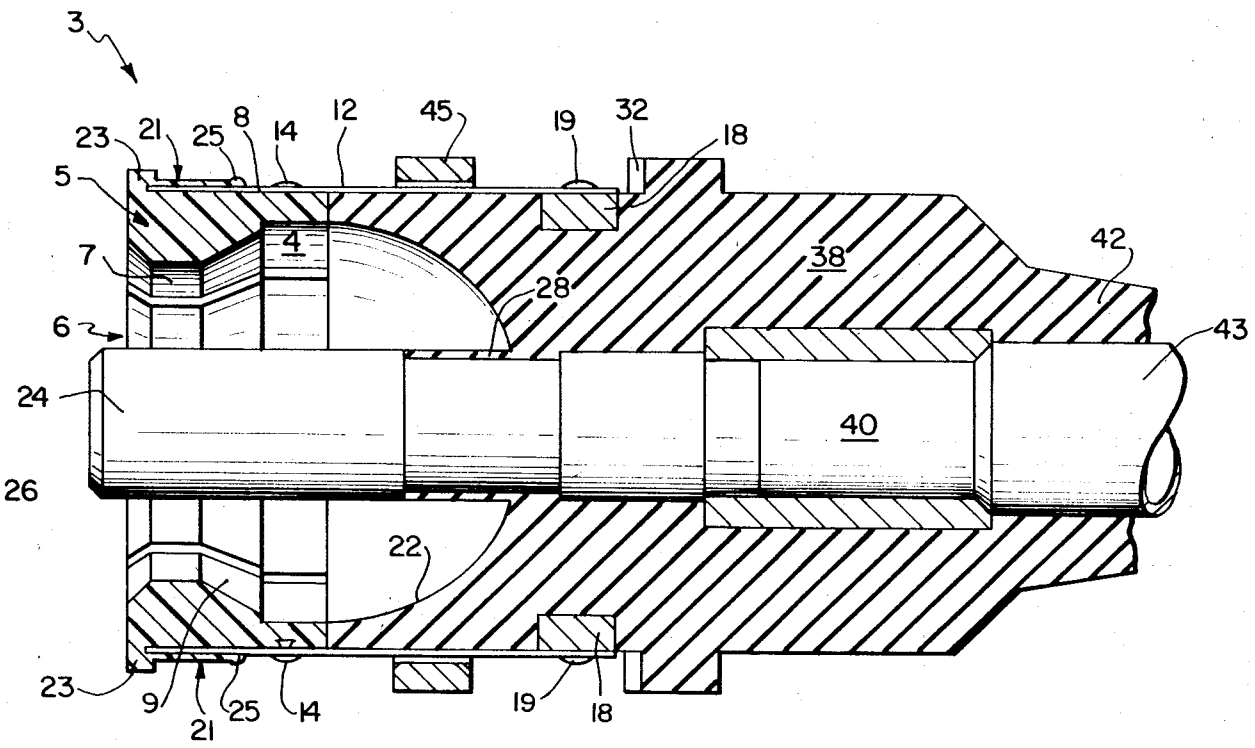
FIG. 6 is a partial cross-sectional view of an alternate embodiment of the male connector of the invention.

FIG. 6 illustrates an alternate embodiment of the male connector 3 of the invention which is particularly well-suited for use in a radioactive environment. The structure of this male connector 3 differs from the previously discussed male connector only with respect to the structure of the collet 5 and collar 45. However, these structural differences lead to some very advantageous effects in a radioactive environment, as will be seen shortly.

In this embodiment, the collet 5 includes a smooth outside surface 12 in lieu of the previously discussed threaded outside surface 11. Additionally, the collet fingers are formed from pads 7 of radiation-resistant plastic (which tends to be non-resilient) fastened onto spring fingers 8 by means of rivets 14. An example of such a plastic is polyphenyl sulphide (PPS), which is commercially available under the brade name "RYTON"®. The smooth exterior surfaces of the spring fingers 8 form the smooth outside surface 12 of the collet 5. While the spring fingers 8 could be formed from a variety of metals such as brass or copper, stainless steel is preferred due to its resistance to the corrosion and radiation degradation that many materials experience in a radioactive environment. In order to anchor the spring fingers 8 into the elastomeric body 20 of the male connector 3, a ring 18 of a suitably hard plastic is molded into this body 20 in the position shown. The rear portion of each spring finger 8 is fastened onto the ring 18 by means of an anchor rivet 19. Ring 18 and anchor rivet 19 serve much the same function in this embodiment of the invention as the collet finger flanges 17 of the FIGS. 1 and 2 embodiment. It should be noted that the heads of the anchor rivets 18 may optionally be dimensioned so as to frictionally retain the freely slidable collar 45 when it is withdrawn to its rearmost position. Capping off the front end of each of the spring fingers 8 is a plastic stop and detent member 21. Member 21 has a stop member 23 for stopping the slidable collar 45, and a detect member 25 for detaining this collar. Specifically, member 21 secures this collar 45 in a locking position when the collar 45 is slid between the stop member 23 and the detect 25. Each stop and detent member 21 is an integral part of each of the plastic pads 7; such a structure allows member 21 to be securely retained in place by the same rivet 14 which binds each of the spring fingers 8 with its respective pad 7. Additionally, each stop and detent member 21 is preferably a little wider than the end of its respective spring finger 8 so that each member 21 caps the front, back and sides of the front end of its respective finger 8.

Female connector 50 illustrated in FIGS. 1 and 2 may be used in conjunction with the male connector 3 of FIG. 6. As will be discussed in detail hereinafter, the provision of a slidable ring over an expandable collet formed from stainless steel and radiation-resistant plastic results in an electrical connector assembly 1 which is substantially more radiation-resistant than prior art connectors. More importantly, the provision of an expandable collet in combination with a freely slidable locking collar provides a connector assembly 1 which may be very rapidly locked and unlocked, thus reducing the amount of time a workman must spend engaging together electrical connectors.

Operation of the Invention

Figure 5:
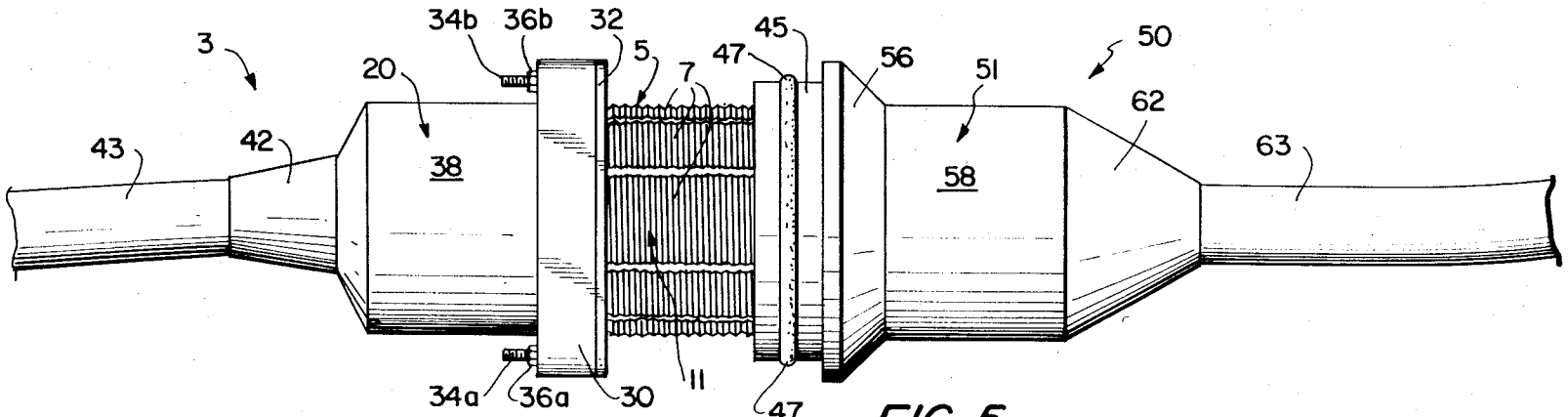
FIG. 5 is a side view of the male and female connectors of FIG. 4, illustrating them in a completely mated and locked position.

FIGS. 4 and 5 specifically illustrate the operation of the connector assembly 1 illustrated in FIGS. 1, 2 and 3. When the user desires to mechanically and electrically couple the male connector 3 with the female connector 50, he first screws the threaded collar 45 into the proximal-most position illustrated in FIG. 4, i.e., against mounting plate 32 of flange 30. Next, he inserts the bevelled end 26 of male pin 24 into the mouth of cylindrical cavity 64. As he begins to slide the pin 24 through the water-sealing O-ring 75 in the cylindrical cavity 64, the bevelled areas 13 of the collet fingers 7 engage the distal portion of the spherical member 52 of the female connector 50. As the male pin 24 is pushed into the mouth of the female barrel 66 in spring-wiping engagement, the distal ends of the collet fingers 7 deflect around the spherical member 52 of the female connector 50. When the male pin 24 is fully inserted within female barrel 66, the distal end of the collet 5 engages against the flat face of the tapered shock flange 56, and the distal ends of the collet fingers which form the mouth 6 of the collet flex around and engage the walls of the neck 54. When the two connectors 3 and 50 are in this position, the O-ring 75 sealingly engages around the elastomeric sleeve 28 at the base of the male pin 24, and forms the previously described watertight seal between the two connecting members. To complete the mechanical and electrical coupling between the two connectors 3 and 50, the operator screws the threaded collar 45 of the threaded outside wall 11 of the collet 5 until it abuts the flat face of the tapered shock flange 56 in the position shown in FIG. 5. To unmate the connectors, the operator merely screws the threaded collar 45 back into the position shown in FIG. 4, and pulls apart the connectors 3 and 50.

The operation of the FIG. 6 embodiment of the invention is generally the same, but with one important difference. Instead of screwing the threaded collar 45 along the threaded outside wall 11 of collet 5 in order to secure the male connector 3 into the female connector 50, the collar 45 is merely slid up over the detent 25 of the stop and detent member 21. The use of a sliding motion in lieu of a screwing motion to longitudinally move the collet 45 is, of course, much quicker. The ability of the FIG. 6 embodiment to quickly mate and unmate the male connector 3 with the female connector 50 minimizes the amount of time that a workman must spend mating together the ends of an electrical connector assembly in a radioactive environment, such as the containment area of a nuclear power plant.

In both embodiments of the invention, an electrical connection is made quickly and easily without the exertion of extraneous torsional forces on the connectors and their associated cables.

Although the present invention has been described with reference to a preferred embodiment, it should be understood that the invention is not limited to the details thereof. A number of possible substitutions and modifications have been suggested in the foregoing detailed description, and others will occur to those of ordinary skill in the art. All such substitutions and modifications are intended to fall within the scope of the invention as defined in the appended claims.

What is claimed is:

1. An electrical connector assembly formed from a pair of mateable electrical connectors which may be locked together mechanically and electrically without the application of torsional forces to either connector, comprising:

(a) a first connector having a collet with a resiliently expandable mouth and a substantially spherical interior which surrounds a first elongated conductive member;

(b) a second connector having a substantially spherical member which is complementary in shape, and capturable within, the spherical interior of said collet for mechanically connecting the first and second connectors, wherein said spherical member includes an elongated cavity having a mouth for receiving the first elongated conductive member, and which houses a second elongated conductive member which mechanically and electrically connects with said first conductive member when said spherical member is inserted through the expandable mouth of the collet and captured within the spherical interior of the first connector;

(c) a sealing means for providing a water-tight seal between said first and second elongated conductive members and the mouth of said elongated cavity when said spherical member is captured within the spherical interior of the first connector and said first and second conductive members are disposed within said cavity, and (d) a ring means which circumscribes said first connector means and which is movable to a collet-locking position around the resiliently expandable mouth of the first connector when said spherical member of said second connector is within said spherical interior of said first connector without the application of torsional forces to said first connector.

2. The electrical connector assembly defined in claim 1, wherein said sealing means includes a resilient O ring which circumscribes the mouth of the elongated cavity.

3. The electrical connector assembly defined in claim 2, wherein said first conductive member is a pin means, and said second elongated member is a barrel means, and wherein said pin means is circumscribed by a sleeve of elastomeric material around its distal end which coacts with said O ring to render a water-tight seal around the pin and barrel when the spherical member of the second connector is captured within the spherical interior of the first connector.

4. The electrical connector assembly defined in claim 1, further including a flange which circumscribes one of said connectors for protecting the electrical connector assembly from mechanical shock.

5. The electrical connector assembly defined in claim 1, wherein the exterior of the first connector is substantially cylindrical, and wherein both the exterior of the first connector and the interior of the ring means are threaded so that the connectors may be locked together by screwing the ring into a position around the collet mouth.

6. The electrical connector assembly defined in claim 1, wherein the exterior of the first connector is smooth, and wherein said ring means is slidably movable over the smooth exterior of the first connector so that the connectors may be locked together by sliding the ring into a position around the collet mouth.

7. The electrical connector assembly defined in claim 6, further including detent means located on the exterior of the first connector for retaining the ring means in a position around the collet mouth.

8. The electrical connector assembly defined in claim 1, wherein both said first and second connectors are formed from a radiation-resistant material.

9. The electrical connector assembly defined in claim 1, wherein said collet is split to define at least two expandable fingers.

10. A process for electrically and mechanically mating first and second electrical connectors, wherein said first connector includes a collet with a resiliently expandable mouth, a ring means which circumscribes its exterior which is movable into a position around the resiliently expandable collet mouth to prevent said mouth from expanding, and wherein said collet has a convex interior which surrounds a first elongated conductive member, and wherein said second connector has a convex member which is complementary in shape, and capturable within, the concave interior of said collet, and said convex member includes an elongated cavity which houses a second elongated conductive member which is mechanically and electrically connectable with the first conductive member, and wherein one of said connectors includes a sealing means for providing a water-tight seal between the mouth of the elongated cavity and said conductive members, comprising the steps of:

(a) pushing the convex member of the second connector through the expandable mouth of the collet with the first elongated conductive member in alignment with the mouth of the elongated cavity so that the convex member of the second connector becomes captured within the concave interior of the second connector while the first and second conductive members become mechanically and electrically connected within said cavity in said convex member with a water-tight seal being formed between the conductive members and the mouth of the cavity by said sealing means, and (b) locking the first and second connectors together by moving said ring means over the exterior of the first connector around the resiliently expandable mouth of the collet.

* * * * *